United States Patent [19]

Westover et al.

[11] 4,431,179

[45] Feb. 14, 1984

[54] TRANSPORT CHANNEL SYSTEMS

[75] Inventors: Dwight G. Westover, Sierra Madre; Raymond M. McManaman, Glendora, both of Calif.

[73] Assignee: Bell & Howell Company, Chicago, Ill.

[21] Appl. No.: 349,410

[22] Filed: Feb. 16, 1982

[51] Int. Cl.[3] ..... B65H 5/02

[52] U.S. Cl. ..... 271/274; 271/8 A

[58] Field of Search ..... 271/8 A, 273, 274

[56] References Cited

U.S. PATENT DOCUMENTS

| | | | |
|---|---|---|---|
| 540,240 | 6/1895 | Dexter . | |
| 1,668,816 | 5/1928 | Low . | |
| 3,107,090 | 10/1963 | Templeton | 271/274 X |
| 3,265,385 | 8/1966 | Schulze . | |
| 3,628,786 | 12/1971 | Maloney . | |
| 3,661,383 | 5/1972 | Morrison . | |
| 4,113,244 | 9/1978 | Ruenzi . | |
| 4,116,556 | 9/1978 | Tanaka . | |
| 4,333,640 | 6/1982 | Miller | 271/274 X |

FOREIGN PATENT DOCUMENTS

| | | |
|---|---|---|
| 52-38225 | 3/1977 | Japan . |
| 55-52840 | 4/1980 | Japan . |
| 1583168 | 1/1981 | United Kingdom . |

*Primary Examiner*—Richard A. Schacher

*Attorney, Agent, or Firm*—Benoit Law Corporation

[57] ABSTRACT

Service access to a transport channel is facilitated by providing a corner for receiving a margin or seam of a wall of the transport channel. A bias is exerted on the margin for pushing such margin into the corner and releasably biasing the wall into a position in which it laterally contains the transport channel. The bias is such as to permit manual tilting of the wall away from the transport channel for service access. After termination of such tilting, the bias restores the wall to its normal position at the transport channel.

12 Claims, 4 Drawing Figures

TRANSPORT CHANNEL SYSTEMS

BACKGROUND OF THE INVENTION

2. Field of the Invention

The subject invention relates to transport channels and to methods for facilitating service access to such transport channels.

2. Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(l) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or its merits contrast the subject invention or its merits against the background of developments which may be subsequent in time or priority.

Transport channels are present in various apparatus, including, for instance, document, sheet or paper conveyors or feeders, document, sheet or paper handling or processing systems, copying apparatus, office machines, and other material handling equipment.

By way of background, reference may be had to U.S. Pat. No. 540,240, by T. C. Dexter, issued June 4, 1895 and showing apparatus for conveying sheets of paper having adjustable brackets for selectively tightening and slackening conveyor tapes for servicing purposes. In U.S. Pat. No. 1,668,816, by C. L. Low, issured May 8, 1928, a top holddown mechanism for a paper feeder is provided with a yoke that is releasably mounted on a crossbar in proximity to a paper conveyor. The yoke is equipped with a set screw which is tightened for attaching the yoke to the crossbar, and which is loosened for a removal of the top holddown mechanism from the paper feeder conveyor. In practice, such set screws generally present an inconvenience to operator and service personnel and also tend to become loose during operation of the sheet transport or feeder.

The U.S. Pat. No. 3,265,385, by E. F. C. Schulze, issued Aug. 9, 1966, disclosed a document feeding apparatus having a removable idler roller assembly held down and selectively released by spring clips. In practice, such spring clips often represent an inconvenience to the operator or to service personnel.

U.S. Pat. No. 3,628,786, by T. O. Maloney et al., issued Dec. 21, 1971, shows a document handling apparatus having a movable coverplate pivotally supported for access to components inside the document handling apparatus. A pivotal support is also shown in U.S. Pat. No. 3,661,383, by D. I. Morrison, issued May 9, 1972 for document handling apparatus having a cover and feed deck hinged for increased accessibility to the remainder of the apparatus. A spring-biased hinge separator gate is apparent from U.S. Pat. No. 4,113,244, by K. Ruenzi, issued Sept. 12, 1978. Hinged or pivoted sheet guideplates in sheet transport apparatus are also seen in Japanese Patent Application No. 52-38225 by T. Yano, published Mar. 24, 1977 and Japanese Patent Application No. 55-52840, by K. Miyamoto, published Apr. 17, 1980. While hinging mechanisms employing a shaft or similar pivot member sometimes represent a design convenience, they often present certain inconveniences when ready access to, or swift removal of objects from, the particular apparatus is desired.

Use of relatively complex pantograph-type and other lever mechanisms to provide service access to the inside of copying apparatus is illustrated in U.S. Pat. No. 4,116,556, by S. Tanaka et al., issued Sept. 26, 1978. British Patent Specification 1,583,168, by J. H. Cook, published Jan. 21, 1981 illustrates use of a drawer-slide member for achieving selective separation of guide plates for a removal of trapped sheets. While such approaches are meritorious in some applications, they tend to introduce complexities and limitations in others.

SUMMARY OF THE INVENTION

It is a general object of this invention to overcome the disadvantages and to meet the needs expressed or implicit in the above disclosure statement or in other parts hereof.

It is a germane object of this invention to provide methods of facilitating service access to transport channels and to provide improved transport channels having such facilitated service access.

It is a related object of this invention to provide improved methods and apparatus for conveying or transporting documents, papers, sheets or other materials.

Other objects of this invention will become apparent in the further course of this disclosure.

From a first aspect thereof, the subject invention resides in a method of facilitating service access to a transport channel bounded by a wall laterally containing the transport channel in a first position of such wall. The method according to this aspect of the invention comprises, in combination, the steps of providing a corner for receiving a margin of the wall at the transport chnnel, providing the wall with a ledge at the margin, exerting on that ledge at the margin a bias pushing such margin into the corner and releasably biasing the wall into its first position, but permitting opening of the transport channel to some extent by manual tilting of the wall away from the transport channel, manually sliding the wall from the corner to open the channel entirely on one side thereof for complete access to the transport channel, and restoring the wall to its first position with the bias after termination of the tilting and after the sliding of the wall from the corner.

From another aspect thereof, the subject invention resides in apparatus having a transport channel and, more specifically, resides in the improvement comprising, in combination, a wall laterally containing the transport channel in a first position of such wall, means defining a corner for receiving a margin of the wall at the transport channel, the wall having a ledge at the margin, means at the corner for exerting on the ledge of the margin a bias pushing such margin into the corner and releasably biasing the wall into its first position, but permitting opening of the transport channel to some extent by manual tilting of the wall away from the transport channel against the bias, and means including the exerting means for mounting the wall to be manually slidable from the corner to open the channel entirely on one side thereof for complete access to the transport channel.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
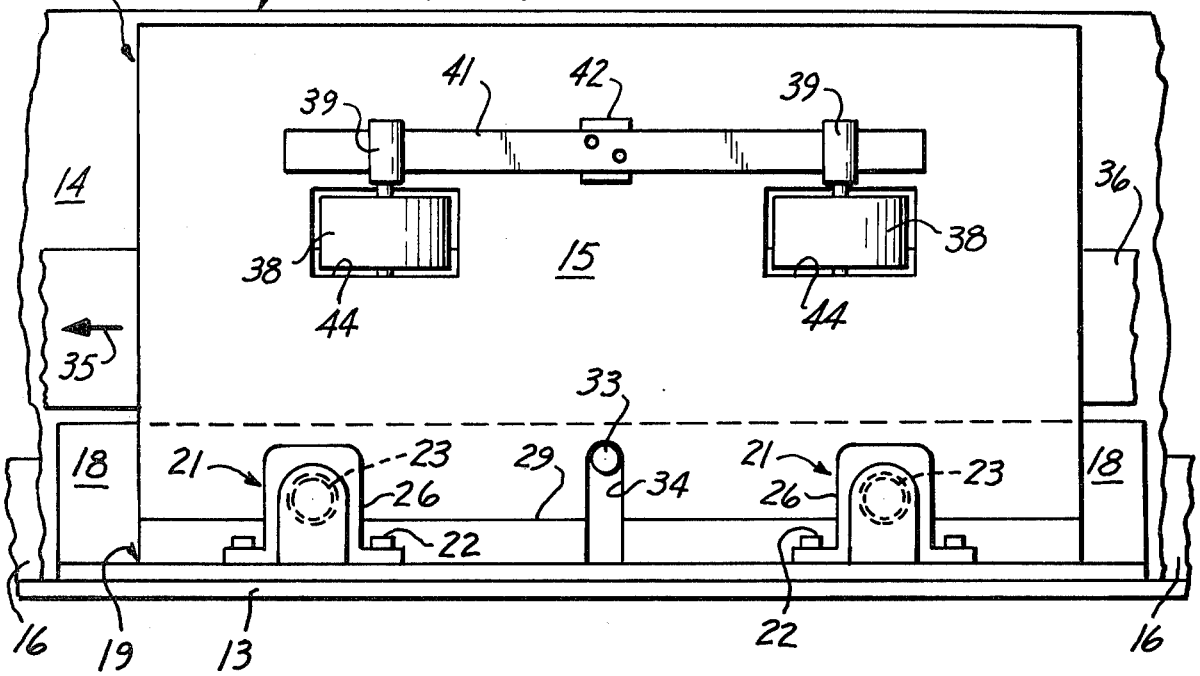
FIG. 1 is an elevation of a sheet transport apparatus with a transport channel according to a preferred embodiment of the subject invention.

The sheet transport apparatus 10 shown in FIGS. 1 to 4 has implemented in an advanced remittance processing system, intended primarily for the processing of bank checks, payment stubs and other remittance documents by banks, public utilities and other institutions regularly receiving payment from customers or patrons. However, it should be well understood that the utility of the subject invention is not limited to any field of application, but extends to various transport and conveyance applications. Similarly, the utility of the illustrated preferred embodiments extends at least to various document, sheet or paper conveying and transporting systems.

The sheet transport apparatus 10 shown in FIGS. 1 to 4 has a transport channel 12 provided on a base or baseplate 13. The channel 12 includes or is defined by two substantially parallel plates or walls 14 and 15.

An angle bracket 16 mounts the wall 14 on the base 13. The wall 14 may thus be stationary relative to the base 13. By way of example, the wall 14 may be a rear wall of the transport channel 12 and may extend at right angles to the base 13.

Figure 2:
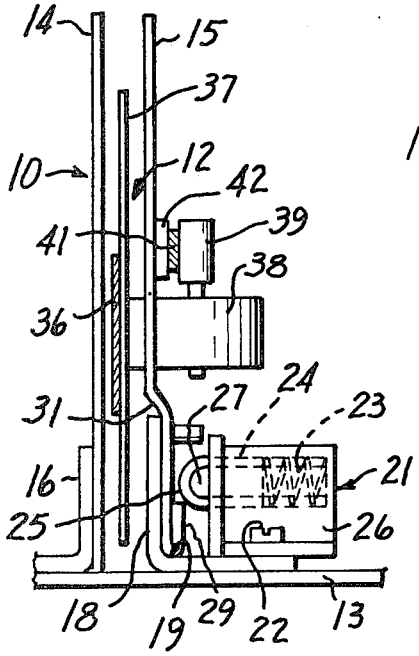
FIGS. 2, 3 and 4 are side views of the apparatus of FIG. 1, showing the transport channel in different conditions accoring a preferred embodiment of the subject invention.

The transport channel 12 is also bounded by the wall 15 which laterally contains the transport channel in the first position of the wall 15 illustrated in FIG. 2.

A second angle bracket 18 is mounted on or affixed to the base 13 at a distance from the rear wall 14 and angle bracket 16 corresponding at least approximately to the depth of the transport channel 12 between the walls 14 and 15. The second angle bracket 18 provides a corner 19 for receiving a margin 20 (FIG. 4) of the wall 15. A biasing device, such as a spring-loaded roller catch 21 is mounted on the angle iron 18 and, if desired, base 13, by fasteners 22.

The roller catch 21 may be of a conventional type, including an internal spring 23 which acts on a plunger 24 for biasing a roller 25 partially out of the front side of a housing 26. The roller 25 may be mounted between a pair of ears 27 projecting from the plunger 24. Alternatively, a bullet-shaped plunger may be employed, in which a dome-shaped catch projects from the housing 26. Use of a roller catch is, however, presently preferred in the practice of the illustrated preferred embodiment shown in FIGS. 1 to 4.

The catch 21 or its spring-biased roller 25 exerts on the lower margin of the wall 15 a bias pushing such margin into the corner 19 and releasably biasing the wall 15 into its erect first position 15 shown in FIG. 2. By way of example, the wall 15 may be a front wall of the channel 12, extending parallel to the rear wall 14 or at right angles to the base 13 in its first position shown in FIG. 2.

Figure 3:
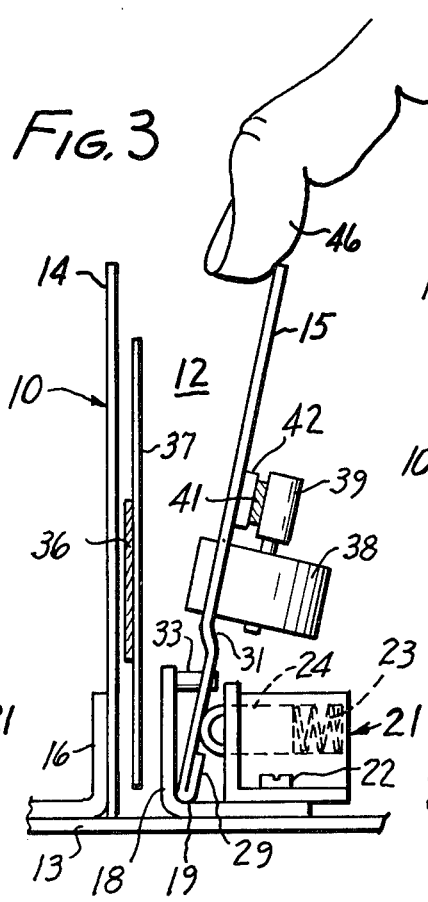
Figure 4:
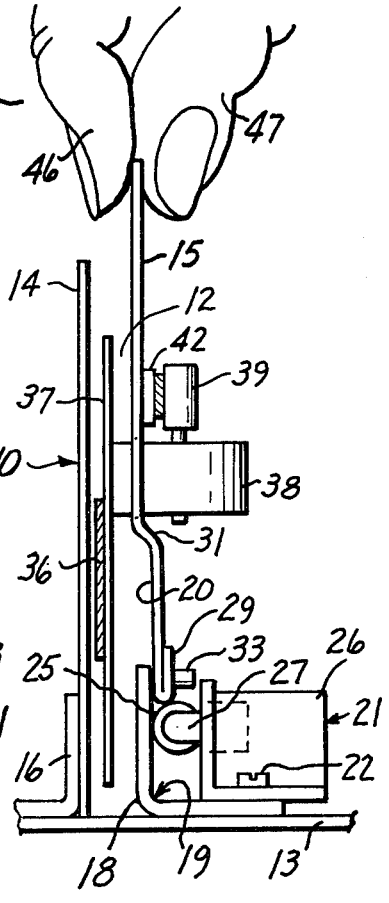
Figure 5:
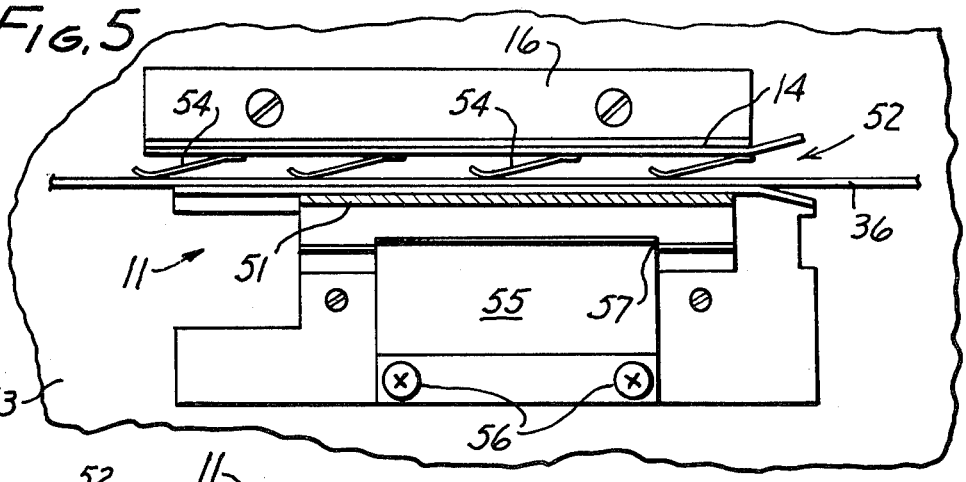
Figure 6:
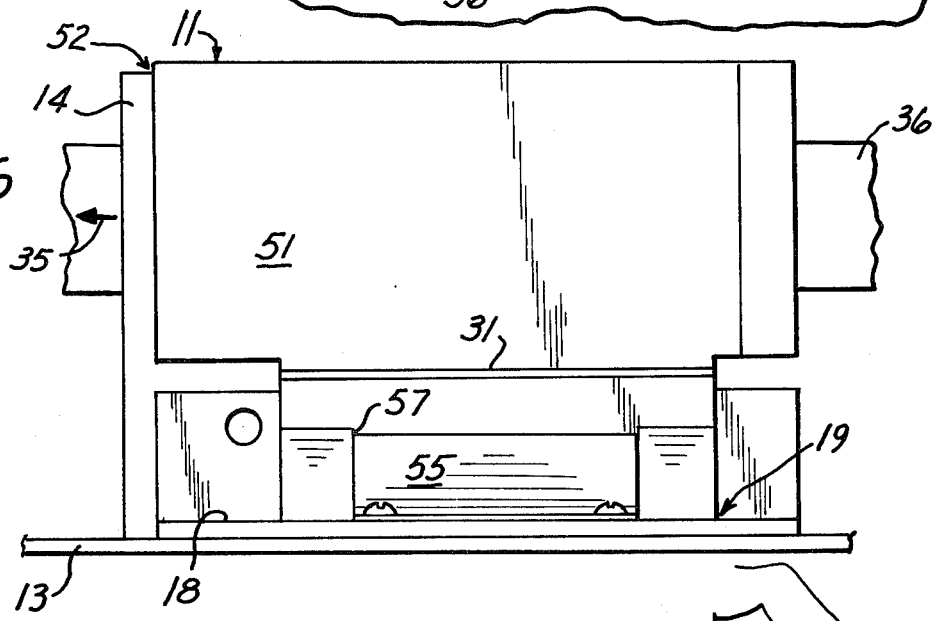
Figure 7:
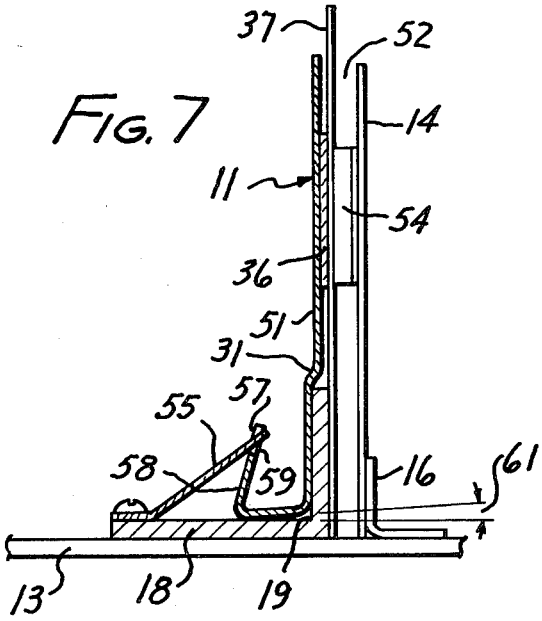
Figure 8:
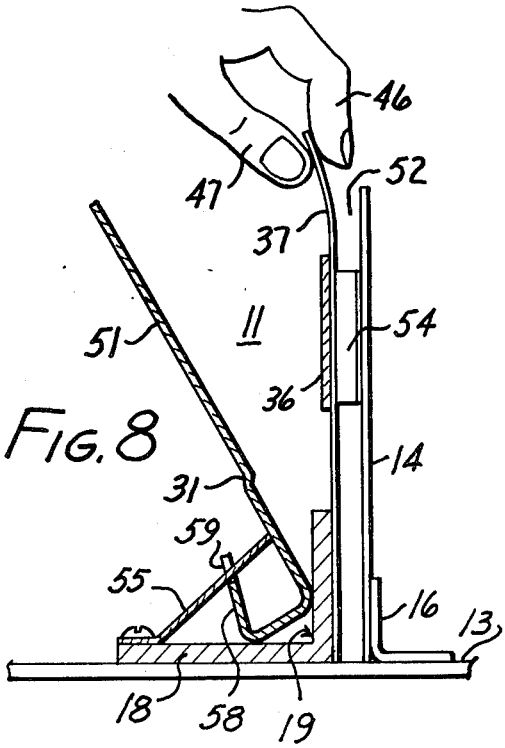

In the preferred embodiment illustrated in FIGS. 1 to 4, the roller 25 acts as a spring-biased detent for exerting the bias on the margin 20 or on a ledge 29 on the wall 15 in the corner 19 or on an edge thereat. As seen in FIGS. 2 to 4, the ledge 29 may be an upturned marginal portion or seam of the wall 15. The catch 21, via its spring-biased roller or detent 25, thus exerts on the lower margin of the wall 15 a force having a vector angle which pushes the wall margin 20 into the corner 19 of the angle bracket 18 and back against the upright leg of the angle bracket 18, thus holding the front wall 19 in its first or vertical position shown in FIG. 2.

As seen in FIGS. 2 to 4, the upper portion of the wall 15 may be offset from its lower margin 20, such as by means of a bend 31, to make up for the thickness of the upright leg of the angle bracket 18. This, in practice, removes a possible source of jamming at the interface of the wall 15 and angle bracket 18.

As seen in the drawings, a conveyor belt 36 runs through the channel 12 for transporting a document 37 therealong. If desired, the wall 15 may carry one or more rollers 38, which engage the document 37 and aid the belt 36 in its conveying function. By way of example, the rollers may be mounted in bearings 39 which are mounted on a leaf-spring 41. That leaf-spring may, in turn, be mounted on a post 42 protecting from an outside of the wall 15. Bearings 39 may, if desired, be provided on both sides of each roller 38, and more than one leaf-spring 48 may be employed for roller mounting purposes. The rollers 38 are preferably mounted on the outside of the wall 15 and extend through openings 44 in the wall 15 in proximity to the conveyor belt 36.

The embodiment shown in FIGS. 1 to 4 thus provides sheet transport means 38 on the wall 15. The sheet transport means 38, if desired, may be supplemental to, and cooperative with, primary sheet transport means 36.

In practice, several of the walls 15 may be disposed side by side along the transport channel 12 for a relatively closed structure.

As seen in FIG. 2 and as indicated above, the illustrated preferred embodiment applies the detent 25 to an edge of the ledge 29 for exerting the requisite wall bias on such edge. In the illustrated preferred embodiments of the subject invention, the bias exerted by the catch 21 or detent 25 permits manual tilting of the wall 15 away from the transport channel 12 or conveyor 36. For instance, a human finger 46, unaided by any tool, may be employed as shown in FIG. 3, for tilting the wall 15 against the bias of the spring 23. In this manner, the transport channel may be opened to some extent for a removal of a jammed document 37, or for other purposes. During tilting of the wall 15, the ledge 29 or the edge of that ledge leaves the roller or detent 25, and such roller or detent then directly engages the margin 20 of the wall 15 as seen in FIG. 3.

The bias of the spring 23 restores the wall 15 to its first position shown in FIG. 2 after termination of the tilting action, such as upon removal of the finger 46 or other tilting agency. During return of the wall 15 from the tilted position shown in FIG. 3 to the upright position shown in FIG. 2, the ledge 29 rides with its protecting edge back onto the roller or detent 25, whereby such roller or detent becomes again slightly spaced from the margin 20 of the wall 15 above the ledge 29.

According to a preferred embodiment of the subject invention, the wall 15 is manually slidable from the corner 19. As shown in FIG. 4, an upper portion of the wall 15 may be gripped by fingers 46 and 47 and manually pulled upwardly whereby the lower wall margin 20 will be pulled from the corner 19 against the bias of the catch 21 or spring 23.

In the preferred embodiment shown in FIGS. 1 to 4, the wall 15 may thus be pulled manually from the corner against its releasable retention at the ledge 29 described above with reference to FIG. 2. In terms of FIG. 4, the wall 15 and margin 20 may be manually pulled out of the corner 19 against action of the detent 25. The ledge 29 is thereby pulled past the detent 25, when manually sliding the wall 15 from the corner 19.

In this manner, the channel 12 may be entirely opened on one side thereof for complete access to the transport channel without resort to any tools.

Similarly, the wall 15 may readily be restored at the transport channel 12 without the use of any tools. For instance, the upper margin of the wall 15 may simply be gripped by fingers 46 and 47, the slot 34 aligned with the pin 33, and the wall 15 pushed downwardly, whereby the margin 20 is pushed into the corner 18, with the ledge 29 sliding past the detent 25 and such detent coming again to rest on the upper edge of the ledge 29. The wall 15 may thus be restored to its channel closing position shown in FIG. 2 by near manual action.

By using several of the walls or panels 15 along the transport channel 12, an entire transport channel or major portions thereof may thus be readily opened for servicing, including such operations as an exchange of the conveyor belt 36, or thorough cleaning of the channel, including the bottom thereof.

Various other modifications and variations within the spirit and scope of the subject invention will become apparent or suggest themselves to those skilled in the art from the subject extensive disclosure.

We claim:

1. A method of facilitating service access to a transport channel bounded by a wall laterally containing the transport channel in a first position of said wall comprising in combination the steps of:

providing a corner for receiving a margin of said wall at the transport channel;

providing said wall with a ledge at said margin;

exerting on said ledge at said margin a bias pushing said margin into said corner and releasably biasing said wall into said first position but permitting opening of the transport channel to some extent by manual tilting of said wall away from said transport channel;

manually sliding said wall from the corner to open said channel entirely on one side thereof for complete access to the transport channel; and restoring said wall to said first position with said bias after termination of said tilting and after said sliding of the wall from the corner.

2. A method as claimed in claim 1, including the steps of:

providing a detent;

exerting said bias on said margin with said detent; and pulling said ledge past said detent, when manually sliding said wall from the corner.

3. A method as claimed in claim 1, including the steps of:

providing a detent;

applying said detent to an edge of said ledge;

exerting said bias on said edge with said detent;

causing said edge of the ledge to leave said detent, whereby said detent directly engages said margin of the wall, during said tilting of the wall;

and causing said ledge to ride with said edge back onto the detent during a return of the wall from a tilted position.

4. A method as claimed in claim 1, including the steps of:

providing a detent;

releasably retaining said margin in said corner with said detent;

manually pulling said wall and margin out of said corner against action of said detent; and thereafter pushing said margin into said corner with said ledge sliding past said detent.

5. In apparatus having a transport channel, the improvement comprising in combination:

a wall laterally containing the transport channel in a first position of said wall;

means defining a corner for receiving a margin of said wall at the transport channel, said wall having a ledge at said margin;

means at said corner for exerting on said ledge at said margin a bias pushing said margin into said corner and releasably biasing said wall into said first position, but permitting opening of the transport channel to some extent by manual tilting of said wall away from said transport channel against said bias; and means including said exerting means for mounting the wall to be manually slidable from said corner to open said channel entirely on one side thereof for complete access to the transport channel.

6. Apparatus as claimed in claim 5, wherein:

said bias exerting means include a detent for exerting said bias on said margin.

7. Apparatus as claimed in claim 5, wherein:

said bias exerting means include a detent engaging an edge of said ledge for exerting said bias on said ledge of said wall.

8. Apparatus as claimed in claim 5, including:

sheet transport means in said transport channel.

9. Apparatus as claimed in claim 5, including:

sheet transport means on said wall.

10. Apparatus as claimed in claim 5, wherein:

said wall is manually slidable from said corner.

11. Apparatus as claimed in claim 5, wherein:

said bias exerting means include a spring-loaded catch.

12. Apparatus as claimed in claim 5, wherein:

said bias exerting means include a spring-loaded roller catch.

* * * * *